US010309394B1

(12) United States Patent
Martin et al.

(10) Patent No.: US 10,309,394 B1
(45) Date of Patent: Jun. 4, 2019

(54) PORTABLE SOLAR POWERED WATER PUMPING SYSTEM

(71) Applicant: Martin's Irrigation Supply, Inc., Seaside, CA (US)

(72) Inventors: Nathaniel J. Martin, Carmel Valley, CA (US); James M. Martin, Pacific Grove, CA (US); Frank S. Martin, Pacific Grove, CA (US)

(73) Assignee: Zaoril, LLC, Monterey, CA (US)

( * ) Notice: Subject to any disclaimer, the term of this patent is extended or adjusted under 35 U.S.C. 154(b) by 195 days.

(21) Appl. No.: 15/223,556

(22) Filed: Jul. 29, 2016

Related U.S. Application Data

(60) Provisional application No. 62/198,437, filed on Jul. 29, 2015.

(51) Int. Cl.

| | |
|---|---|
| ***F04B 35/04*** | (2006.01) |
| ***F04B 35/06*** | (2006.01) |
| ***F04B 53/22*** | (2006.01) |
| ***F04D 13/08*** | (2006.01) |
| ***F04D 29/42*** | (2006.01) |
| ***F04D 29/60*** | (2006.01) |
| ***F04D 29/70*** | (2006.01) |

(52) U.S. Cl.
CPC ..... *F04B 53/22* (2013.01); *F04B 35/04* (2013.01); *F04B 35/06* (2013.01); *F04D 13/08* (2013.01); *F04D 29/4293* (2013.01); *F04D 29/60* (2013.01); *F04D 29/708* (2013.01)

(58) Field of Classification Search
CPC ..... F04B 53/22; F04B 35/04; F04B 35/06; F16L 55/07; F04D 29/4293; F04D 29/60; F04D 29/70; F04D 29/708; F04D 13/08
USPC ..... 417/234
See application file for complete search history.

(56) References Cited

U.S. PATENT DOCUMENTS

| | | | | |
|---|---|---|---|---|
| 1,909,578 | A * | 5/1933 | Franke | F04D 13/066 210/242.1 |
| 4,966,534 | A * | 10/1990 | Hasslen, III | F04D 9/006 417/423.15 |
| 5,620,314 | A * | 4/1997 | Worton | F04B 9/14 417/437 |
| 6,174,146 | B1 * | 1/2001 | Lacy | F04D 15/0218 417/423.14 |
| 6,179,218 | B1 * | 1/2001 | Gates | B05B 17/08 239/17 |
| 6,189,811 | B1 * | 2/2001 | Rudy | F04B 17/006 239/375 |
| 7,648,629 | B2 * | 1/2010 | Prokopchuk | C02F 1/003 210/170.05 |
| 8,056,284 | B2 * | 11/2011 | He | A01G 25/167 47/63 |

(Continued)

*Primary Examiner* — Nathan C Zollinger
(74) *Attorney, Agent, or Firm* — JRG Attorneys at Law

(57) ABSTRACT

A portable solar powered water pumping system having plumbing parts manually coupled together to provide a water tight interference fit for allowing the pump to be assembled and disassembled without tools. The system includes a solar powered pump having an intake chamber and an outflow nozzle. The system also includes a discharge output assembly coupled to the outflow nozzle assembly for directing the water flow to a location selected by a user. The system further includes at least one solar powered connecter for connecting to at least one solar panel to directly power the pump with DC power generated from the solar panel.

12 Claims, 8 Drawing Sheets

(56) References Cited

U.S. PATENT DOCUMENTS

| | | | | |
|---|---|---|---|---|
| 8,297,952 | B2 * | 10/2012 | Wu | F04D 13/10 137/269 |
| 9,011,095 | B2 * | 4/2015 | Parker | F04D 29/426 415/206 |
| 9,810,241 | B2 * | 11/2017 | Gell, III | F04D 15/0218 |
| 2003/0091440 | A1 * | 5/2003 | Patel | F04B 39/121 417/12 |
| 2010/0303654 | A1 * | 12/2010 | Petersen | F04B 35/06 417/423.7 |
| 2011/0247970 | A1 * | 10/2011 | Evingham | B01D 29/21 210/85 |
| 2012/0148427 | A1 * | 6/2012 | Irving | F04B 17/006 417/411 |
| 2014/0098525 | A1 * | 4/2014 | Bennett | H02J 7/0052 362/183 |
| 2014/0322051 | A1 * | 10/2014 | Bartl | F04B 9/14 417/443 |
| 2014/0341752 | A1 * | 11/2014 | Gell, III | F04D 15/0218 417/44.1 |

* cited by examiner

PORTABLE SOLAR POWERED WATER PUMPING SYSTEM

This application claims priority to U.S. provisional application 62/198,437, entitled "Portable Solar Powered Water Pumping System", filed on Jul. 29, 2015.

TECHNICAL FIELD

The present invention relates to water pumping systems, and more particularly, to portable water pumping systems powered by solar energy, having parts coupled together by a tight interference fit for convenient assembly and disassembly without tools.

BACKGROUND OF THE INVENTION

Today's electrically powered, prior art water pumping systems include a wide variety of water pumps, including diesel, electric, mechanical, centrifugal pumps, axial flow pumps, jet pumps, wind powered pumps, electromagnetic pumps and hand pumps. However, most of these pumps do not offer an optimal combination of low cost, low maintenance and operation, and high water volume. For example, most of the water pumps mentioned above require ample amounts of costly energy to run continuously. Wind powered pumps are expensive and limited to having relatively constant high wind. A diesel system requires a supply of fuel. The simplest type of pump is of course a hand pump. Nevertheless, a hand pump is very labor intensive, diverting manpower from other productive tasks, and only provides low water volume.

Sunlight is plentiful in most areas of the earth, with up to 10 useful hours of sun in the warmer latitudes. A self-contained water pumping system which requires no power source during the day other than the sun, and which converts the sun's heat directly to electrical energy is highly desirable. Further, a water pumping system powered entirely by solar power that can be assembled and disassembled, without the need for tools and having reliable interconnection while in use is highly desirable.

In light of the shortcomings in the prior art, there clearly exists a need for an improved water pumping system that is portably powered by solar energy by day, low in maintenance, easily operated and reliable and fully disconnected and reconnected in any of a variety of applications where movement of water is needed. This particular need has led directly to the development of a portable solar powered water pumping system that is easily assembled and disassembled without the need of tools.

SUMMARY OF THE INVENTION

The present invention is a new solar powered water pumping system for pumping water from one location to another to reduce the amount of electricity used to power the pump, thus reducing a user's overall electricity bill.

The present invention also includes a solar powered water pump that is easily assembled and disassembled without the need of tools according to a reliable, tight interference fit among its component parts allowing for easy cleaning and repairs thereof.

The present invention additionally provides a solar powered water pumping system that includes parts coupled together comprising a pump having an intake chamber and an outflow nozzle; an output adapter coupled to the outflow nozzle to allow water that is being pumped from a source to be discharged therefrom; at least one solar energy panel electrically connected to the pump, by means of a solar panel connector, to allow the pump to run directly off the DC power generated from the solar panel to eliminate the need of an inverter; and a water tight interference fit to allow the coupled parts of the solar powered water pump to be assembled and disassembled without the need of tools.

Another aspect of the present invention is to provide a low cost, high efficiency solar powered water pumping system that is comprehensively configured to circulate, relocate, empty, fill, and filter sediment front, or within, or for stagnant or flowing bodies of water such as, but not limited to, an ocean, sea, lake, pond, stream, water troughs, creek, reservoir, lagoon, basin, pond, bayou, stream, blight, stream brook, canal, channel, cove, delta, estuary, straits, inlets, fiord, gulf, headland, harbor, dam, kettle, kill, lock, swamp, marsh, moat, phytotelma, rill, roadstead, spring, tide pool, wetland, port, or waterway.

A further aspect of the present invention is to provide a solar powered water pumping system that utilizes at least one solar panel to convert sunlight to electricity for powering the pump.

An additional aspect of the present invention is to provide a water pumping system of practical design that is affordable, eco-friendly and compact enough for portable use.

The present invention also provides a solar powered water pumping system which can be easily stored since it is configured to be quickly assembled and disassembled.

The present invention further provides a solar powered water pumping system used to recycle water or to facilitate the flow of water to deter mosquito breeding.

An additional aspect of the current invention is to provide a solar powered water pumping system that can be advantageously used to create a low cost, environmental friendly solution for personal aquaponics, fountains, waterfalls, grey water systems, personal spring water, tank filling, rain water harvesting systems, backpacking, camping, landscaping and/or outdoor water features, livestock watering, and/or water tank filtration.

It is a further feature of the invention to provide a new solar powered water pumping system that has an output adapter coupled to the outflow nozzle of a pump to directly connect the solar powered water pump to a plurality of plumbing fittings for advantageously pumping and/or moving water from one place to another. The various fittings include, but are not limited to, PVC fittings, PVC piping and polyethylene tubing, in which all aforementioned fittings having various radiuses depending on the size of the outflow nozzle of the pump.

Consequently, for a better understanding of the present invention, its functional advantages and the specific objects attained by its uses, reference should be made to the accompanying drawings, claims and descriptive matter in which there are illustrated preferred embodiments of the invention.

DETAILED DESCRIPTION OF THE INVENTION

The following detailed description is of the best currently contemplated modes of carrying out various embodiments of the invention. The description is not to be taken in a limiting sense, but is made for at least the purpose of illustrating the general principles of the invention, since the scope of the invention is best defined by the appended claims.

While the preferred embodiments, as described hereafter, refer to the practice of the present invention in conjunction with water to solve water related issues, it should not be understood that the present invention may only be applied to water. It is envisioned that the claimed invention may be applied for filtration, displacement, mixing, or flow to any liquid.

The present invention is a portable solar powered water pumping system used for pumping and moving water from one location to another having at least one solar energy panel for saving energy and for eliminating the need of an inverter. In one embodiment of the invention, the solar powered water pumping system provides a pump that is directly connected to a plurality of plumbing parts and/or fittings. The new apparatus helps to achieve this goal by employing a solar powered pump having a water outflow nozzle that is coupled to an output adapter to allow the pump to be connected to various plumbing parts in order to pump and/or move water from one place to another.

Figure 1:
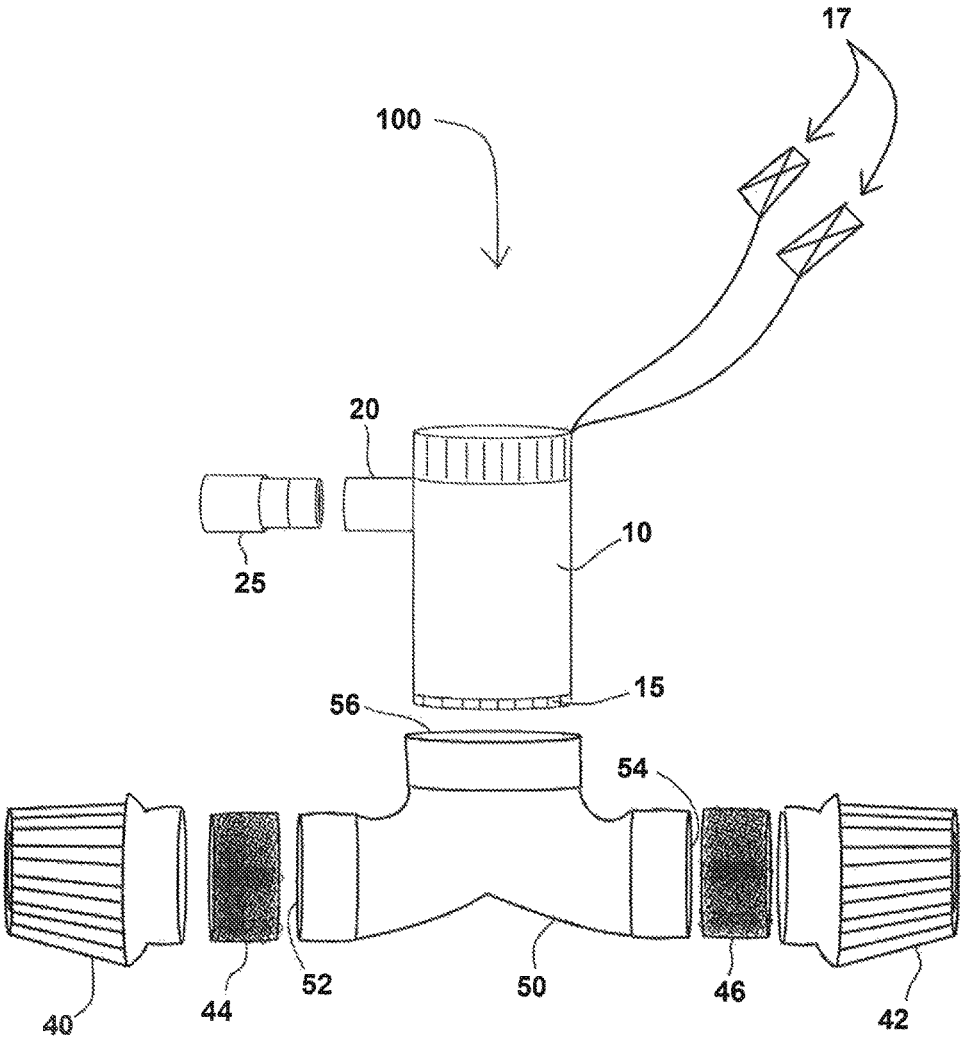
FIG. 1 is a front view of the solar powered pumping system in a disassembled state.
Figure 2:
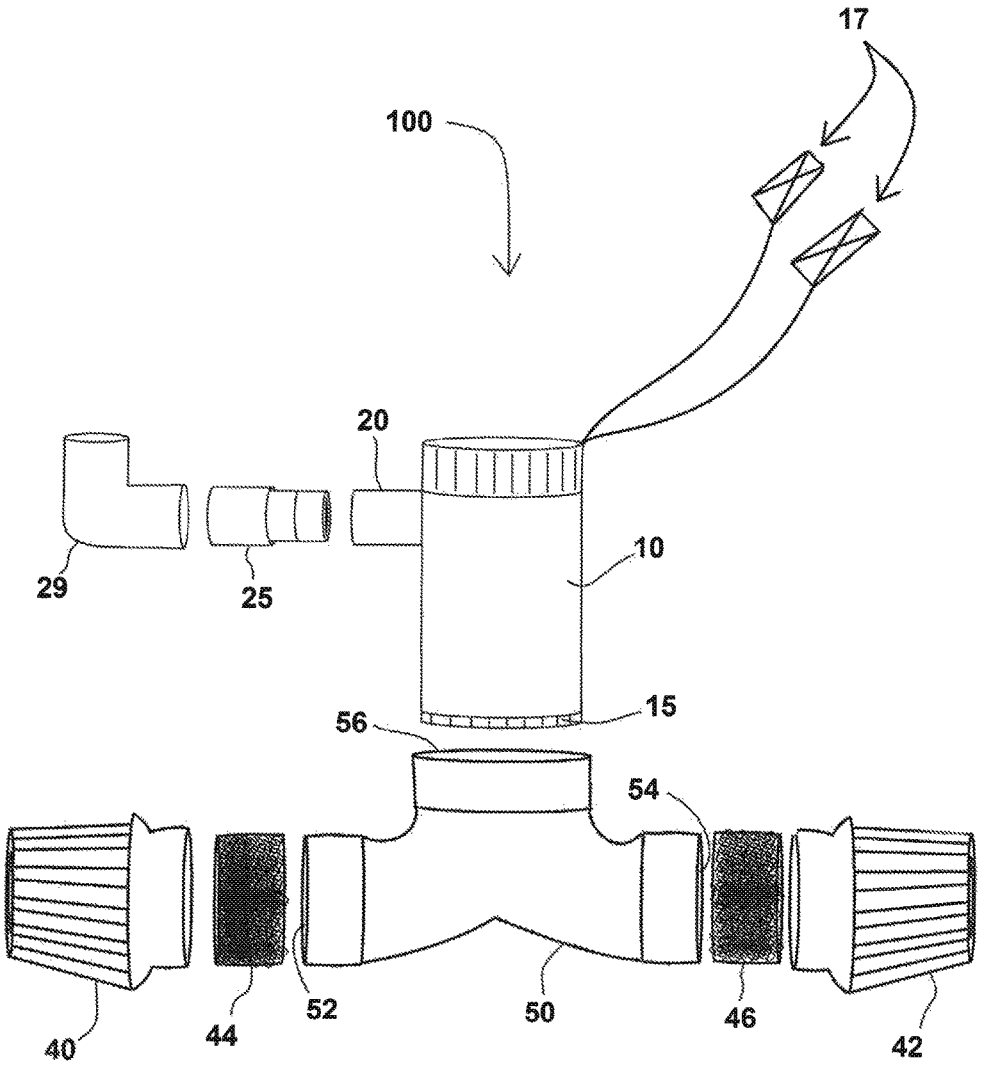
FIG. 2 is a front view of the solar powered water pumping system in a disassembled state and having an optional fitting corrector for connecting to the discharge output adapter.

Referring now to the drawings, FIGS. 1 and 2 refer to one embodiment of the invention depicting the portable solar powered water pumping system 100 in a disassembled state. The portable solar powered water pumping system 100 includes a pump/pump housing 10 having intake chamber 15 and outflow nozzle 20. The intake chamber 15 provides a means for drawing in water. The outflow nozzle 20 allows the water that is being drawn in by the pumping system 100 to be discharged to an area selected by a user.

An alternative embodiment of the invention includes a bilge pump 10 having the following optional parameters: 1100 gallons per hours, 12 volts, 3 amps, 5 amp fuse, 29MM ID hose connection, and an intake screen being a part of the pump assembly.

Referring still to FIGS. 1 and 2, a drain vent fitting 50 is illustrated having a first end 56, a second end 52 and a third end 54. The first end 56 is connected to the intake chamber 15 by means of a water tight interference fit. A first atrium grate 40 is connected to the second end 52 of the drain vent fitting 50 by the water tight interference fit. A first filter 44 is enclosed within the first atrium grate 40 and the second end of the drain vent fitting 52 for filtering the water that is being pumped out of a location. One embodiment of the invention uses a black or green MATALA filter for trapping medium size particles. Both the green and black MATALA filters clean easily by either shaking the debris out or by using a garden hose to spray them clean. Another embodiment of the invention includes a drain vent fitting 50 having the following optional parameters: double ¼ bend, 2" size, G1 of 2⁵⁄₁₆ and G2 of 2⁵⁄₁₆.

A second atrium grate 42 is coupled to the third end of the drain vent fitting 54 by the water tight interference fit as shown in FIGS. 1-2. A second filter 46 is enclosed within the second atrium grate 42 and the third end of the drain vent fitting 54 for filtering the water that is being pumped out of a location. Another embodiment of the invention uses a black or green MATALA filter for trapping medium size particles. An output adapter 25 is beneficially coupled to the water outflow nozzle 20 by the tight interference fit to allow the water that is being pumped from a location to be discharged to an area selected by the user. Importantly, an output adapter 25 is not customarily used or coupled to the outflow nozzle 20 of a bilge pump 10—a discovery that allows the pump 10 to be connected to three separate connectors 29 and/or fittings 29. For instance, the invention is suitably configured to include an output adapter 25 having the following parameters: ID bonds over ½" PVC pipe, OD bonds into ¾" PVC socket, and use w/A 700 tubing (½" tubing).

In this disclosure, the terms "second end" and "third end" refer to, but are not limited to, the at least one intake end. Also, the term "first end" refers to, but is not limited to, coupling end. Accordingly, it is anticipated in this disclosure that the discharge output adapter may have one coupling end, previously referred to as the first end, and any number of intake ends, previously referred to as the second and third ends.

In an alternative embodiment, drain vent fitting 50 has a coupling end, connected to the intake chamber 15 by means of a water tight interference fit. Drain vent fitting 50 additionally has at least one intake end. Furthermore, an atrium grate can be attached to each of the intake ends of drain vent fitting 50. The atrium grates may be attached to each intake end through a tight interference fit. A filter may also be inserted, enclosed within the tight interference fit between each atrium grate and the intake ends.

Figure 3:
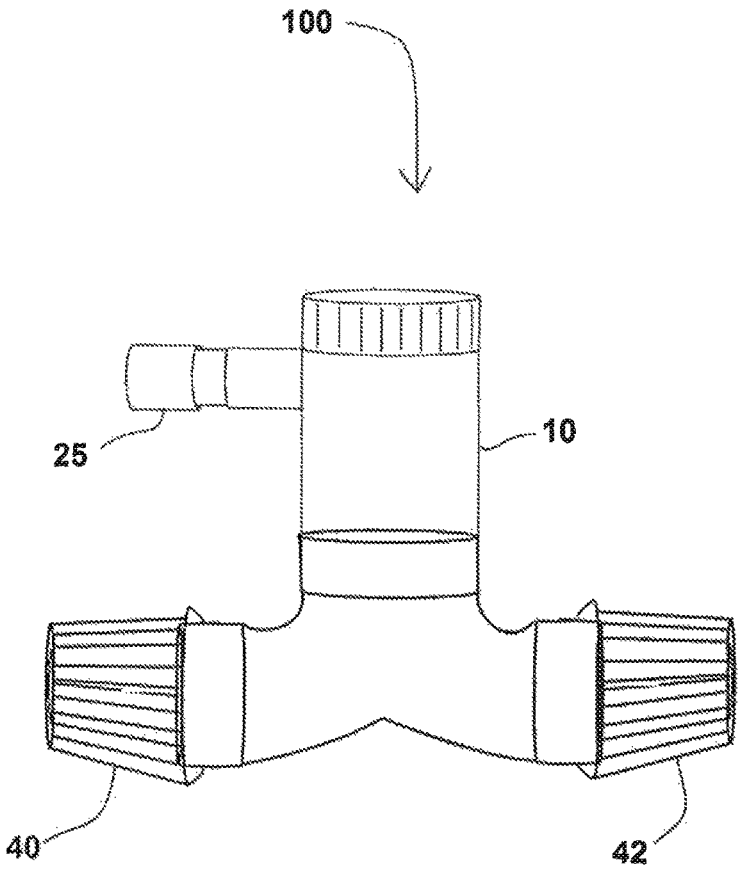
FIG. 3 is a front view of the solar powered water pumping system in an assembled state.
Figure 4:
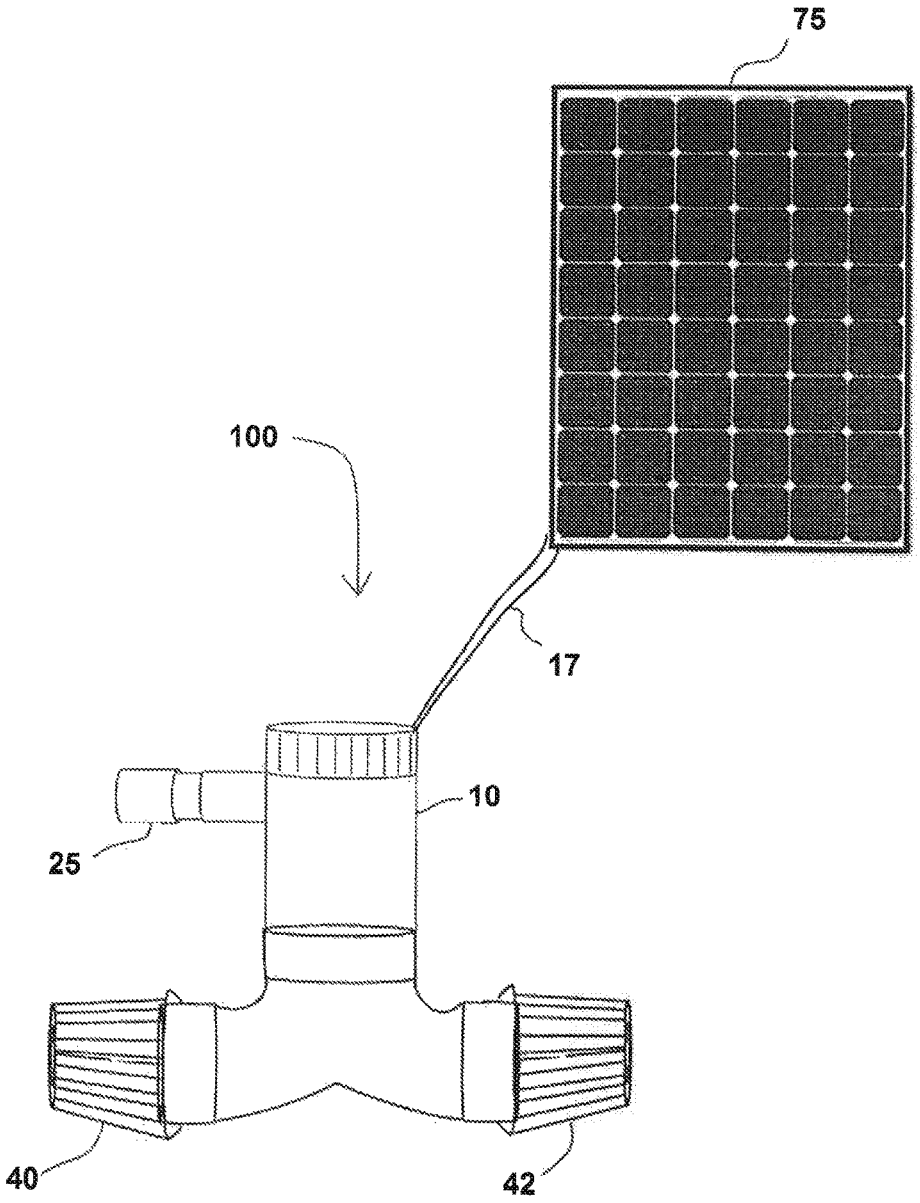
FIG. 4 is a front view of one embodiment of the solar powered water pumping system in an assembled state and connected to a solar energy panel.

The water tight interference fit (also known as tight interference fit) provides a sufficiently tight seal for keeping the plurality of plumbing parts securely connected to each other. As shown in FIGS. 3-4, the plurality of plumbing parts comprising the solar powered water pumping system 100 are fully assembled and securely held together by the water tight interference fit. Additionally, the water tight interference fit is configured to allow the solar powered water pumping system to be assembled and disassembled among its component parts, by hand, without the need of tools as illustrated in FIGS. 1-4.

In use, the present invention is suitably configured to be applied to still bodies of water in order to prevent the breeding and birthing of disease bearing mosquitos. Because the present invention is solar powered, the solar powered pump is naturally designed to disengage in the evening and night, coinciding with the period in which female mosquitos are most active. The body of water to which the present invention is applied will appear to be still-water during the night, and will attract mosquitos to breed. During the sunlight hours, the solar powered pump will be beneficially reengage and any spawned mosquito eggs or larva will be destroyed in the pump mechanisms or any added filters.

As shown in FIGS. 1-2, the solar powered water pumping system includes MC4 connectors 17 for connecting the water pumping system 100 to at least one solar energy panel as illustrated in FIG. 4. Optionally, the MC4 connectors 17 are single-contact electrical connectors commonly used for connecting solar energy panels. MC4s allow strings of energy panels to be easily constructed by pushing the connectors from adjacent panels together by hand, but require a tool to disconnect them to ensure they do not accidentally disconnect when the cables are pulled. Optionally, the parameters of the MC4s are: 18/2 VNTC; 600v low; and Omni cable A11802F.

Alternatively, one embodiment of the invention provides a new solar water pumping system 100 having a discharge output adapter 25 connected to the water outflow nozzle 20 of the pump 10 or bilge pump 10 to allow the solar water pumping system 100 to be directly connected to various fittings 29 for pumping and/or moving water from one place to another as depicted in FIG. 2. The various and optional fittings 29 include, but are not limited to, PVC fittings, PVC piping and polyethylene tubing, in which all aforementioned fittings having various radiuses depending on the size of the outflow nozzle 20 of the pump 10. For example, the output fitting 25 could be connected to a ¾" pipe fitting, ½" PVC pipe or a ⅝" polyethylene tube. An optional PVC pipe elbow fitting 29 is illustrated in FIG. 2, which is coupled to discharge output adapter 25 for allowing water to be discharged to a location designated by the user.

A further embodiment of the invention includes at least one monocrystalline solar pv panel. The optional parameters of the panel are: maximum power: 60 watts; output tolerance: +/−1%; vmp: 18.2 volts; Imp: 3.3 amps; Voc: 22.2 volts; Isc: 3.6 amps; maximum system voltage: 1000 volts; fuse rating max.: 15 amps; weight: 15 Kg; and dimensions of 630 mm (H)×670 mm (L)×30 mm (W).

Figure 5:
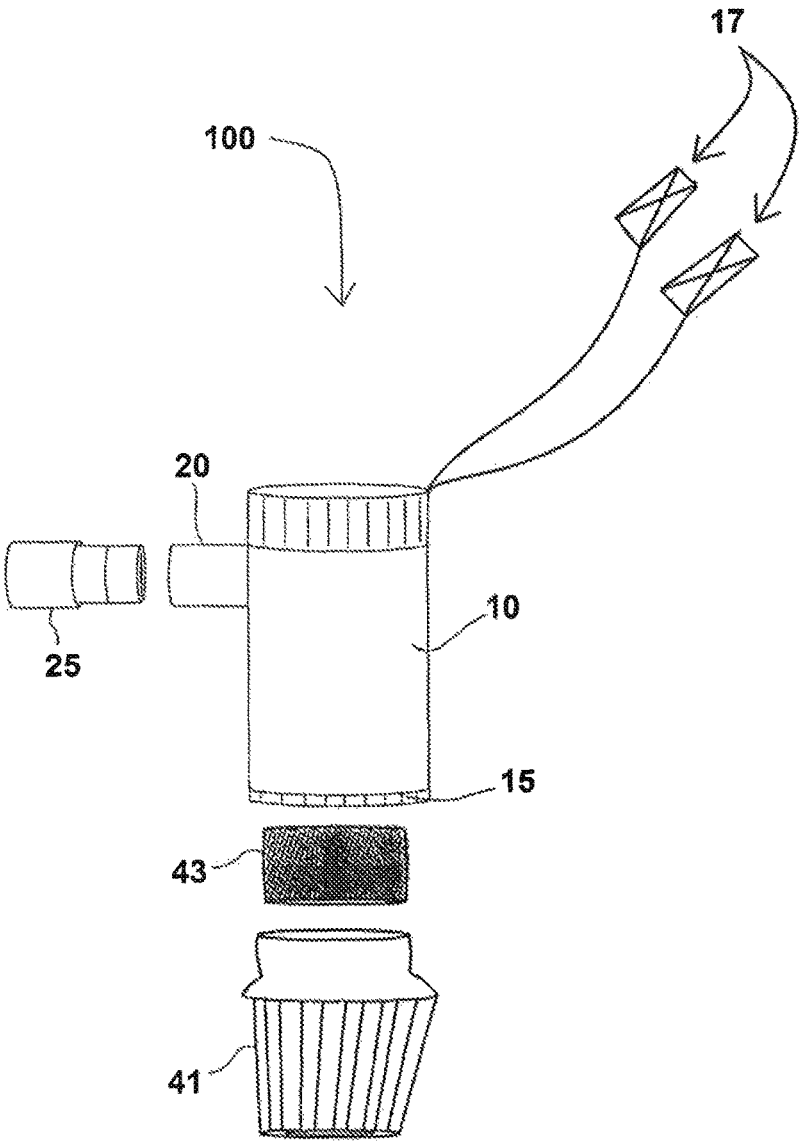
FIG. 5 is a front view of another solar powered water pumping system in a disassembled state.

FIG. 5 refers to an alternative embodiment of the invention depicting the portable solar powered water pumping system 100 in a disassembled state. The portable solar powered water pumping system 100 includes a pump 10 having a water suction intake chamber 15 and water outflow nozzle 20. The water suction intake chamber 15 provides a means for drawing in water. The water outflow nozzle 20 allows the water that is being drawn in by the pumping system 100 to be discharged to an area selected by a user.

Figure 6:
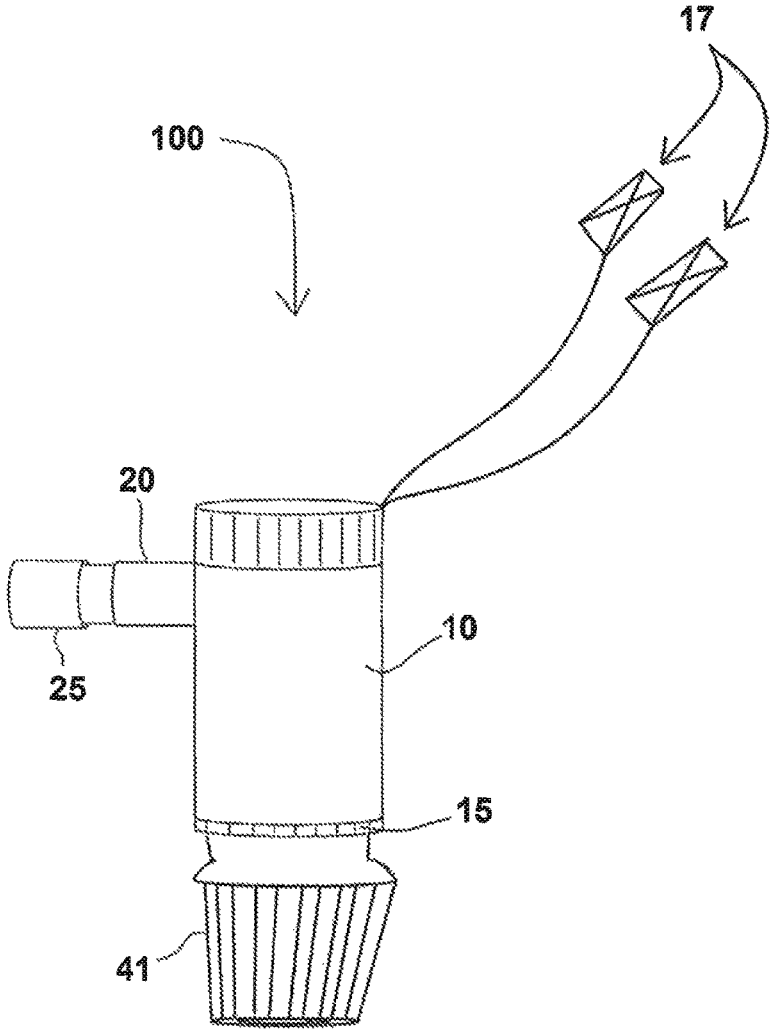
FIG. 6 is a front view of the solar powered water pumping system of FIG. 5 in an assembled state.

Referring to FIGS. 5 and 6, an atrium grate 41 is directly connected to the water suction intake chamber 15 by the water tight interference fit. The water tight interference fit is suitably designed so the parts may be advantageously connected and disconnected at will, without the need for additional tools. A filter 43 is beneficially enclosed within the atrium grate 41 and the water suction intake chamber 15 for filtering the water that is being pumped out of a location. One embodiment of the invention uses a black or green MATALA filter for trapping medium size particles. Both the green and black MATALA filters clean easily by either shaking the debris out or by using a garden hose to spray them clean. Additionally, in this embodiment, various fittings 29 may be attached to the water discharge output adapter 25 so that a user may direct the outflow of water to a desired location. The various and optional fittings 29 include, but are not limited to, PVC fittings, PVC piping and polyethylene tubing, in which all aforementioned fittings having various radiuses depending on the size of the outflow nozzle 20 of the pump 10. Further, FIG. 6 refers to the solar powered water pumping system 100 of FIG. 5 in an assembled state.

Figure 7:
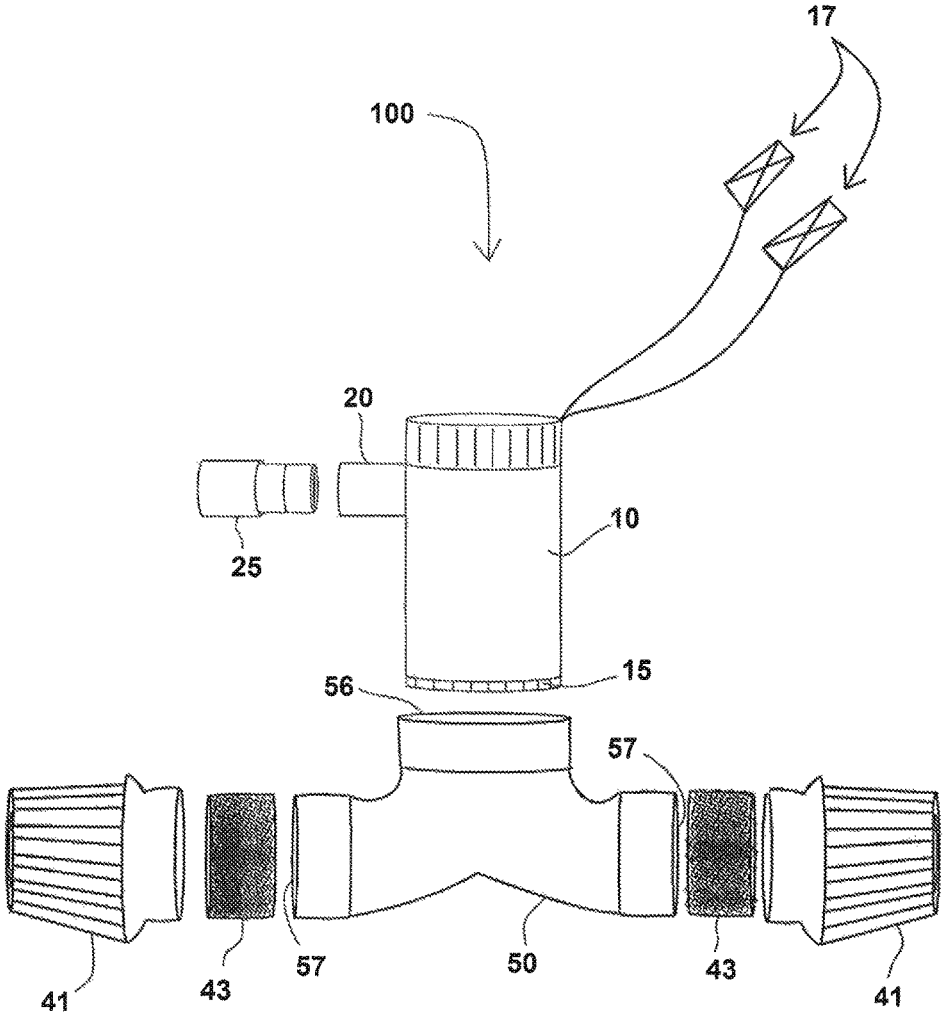
FIG. 7 is a front view of the solar powered water pumping system in a disassembled state and configured to attach to at least one atrium grates.
Figure 8:
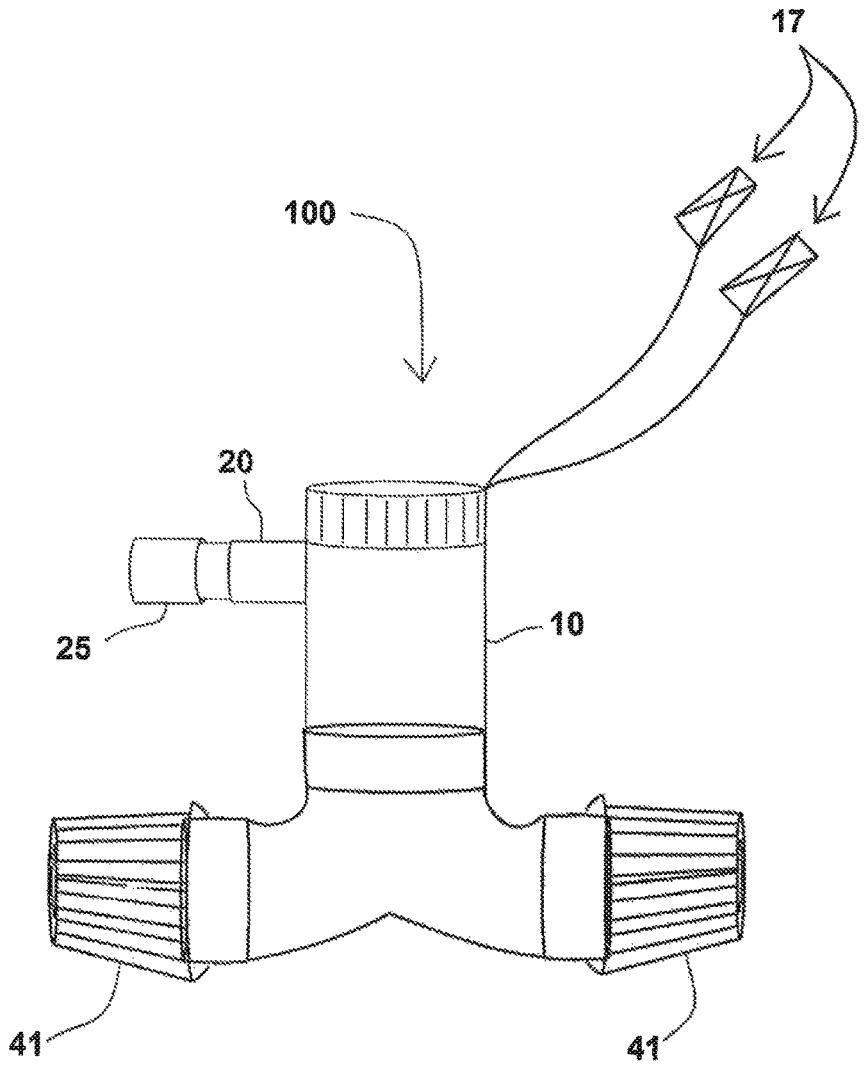
FIG. 8 is a front view of the solar powered pumping system of FIG. 7 in an assembled state.

Another embodiment of the invention is highly adaptive in that it includes a drain vent fitting 50 configured to attach to a plurality of atrium grates as shown in FIG. 7. The drain vent fitting 50 includes a first end 56 configured to attach to the water suction intake chamber 15. As previously discussed in this disclosure, first end 56 may also be referred to as a coupling end. The drain vent fitting 50 further includes a plurality of atrium connectors 57 configured to connect to a plurality of atrium grates 41 by the water tight interference fit. A filter 43 is beneficially enclosed within each atrium grate 41 for filtering the water that is being pumped out of a location. Further, FIG. 8 is a front view of the solar powered water pumping system of FIG. 7 in an assembled state.

It should be understood that the foregoing relates to various embodiments and uses of the invention and that modifications may be made without departing from the spirit and scope of the invention. It should also be understood that the present invention is not limited to the designs mentioned in this application and the equivalent designs in this description, but it is also intended to cover other equivalents now known to those skilled in the art, or those equivalents which may become known to those skilled in the art in the future.

What is claimed is:

1. A portable solar powered water pumping system having a plurality of plumbing parts coupled thereto for directing water flow as desired, the system comprising:

a solar powered water pump having an intake chamber, an outflow nozzle, and a solar panel connector, wherein the intake chamber having a larger diameter than the diameter of the outflow nozzle, and the intake chamber further including a diameter being substantially equal to the diameter of the pump housing;

a drain vent fitting having at least one intake end and one coupling end, wherein the coupling end is coupled to the intake chamber;

at least one atrium grate coupled to the at least one intake end of the drain vent fitting;

a filter enclosed within the coupling of the at least one atrium grate at the at least one intake end; and at least one remotely located solar energy panel coupled to the solar panel connector, said plumbing parts being configured to be manually coupled and uncoupled to the solar powered water pump without the need of tools.

2. The solar powered water pumping system according to claim 1, wherein the configuration of the plumbing parts provide a water tight interference fit, whereby the tight interference fit is a press or friction fit.

3. The solar powered water pumping system according to claim 1, wherein the plurality of plumbing parts further includes a discharge output adapter manually coupled to the outflow nozzle, said discharge adapter being configured to be connected to a plurality of fittings or connectors.

4. The solar powered water pumping system according to claim 3, wherein the discharge output adapter is selected from the group consisting of: PVC fittings, PVC piping, and polyethylene tubing.

5. The solar powered water pumping system according to claim 1, wherein the solar panel connector is an MC4 connector, and wherein the solar panel is a monocrystalline solar panel.

6. The solar powered water pumping system according to claim 1, wherein the solar powered pump is a bilge pump.

7. A solar powered water pumping kit assembly having a plurality of plumbing parts coupled thereto for directing water flow as desired, the assembly comprising:

a solar powered water pump having an intake chamber, an outflow nozzle, and a solar panel connector, wherein the intake chamber having a larger diameter than the diameter of the outflow nozzle, and the intake chamber further including a diameter being substantially equal to the diameter of the pump housing;

a drain vent fitting having at least one intake end and one coupling end, wherein the coupling end is coupled to the intake chamber;

at least one atrium grate coupled to the at least one intake end of the drain vent fitting;

a filter enclosed within the coupling of the at least one atrium grate at the at least one intake end; and at least one remotely located solar energy panel coupled to the solar panel connector, the plumbing parts being configured to be manually coupled and uncoupled without the need of tools.

8. The water pumping kit assembly according to claim 7, wherein the configuration of the plumbing parts provide a water tight interference fit, whereby the tight interference fit is a press or friction fit.

9. The water pumping kit assembly according to claim 7, wherein the the plurality of plumbing parts further includes a discharge output adapter for coupling the outflow nozzle, said discharge adapter being configured to be connected to a plurality of fittings or connectors.

10. The water pumping kit assembly according to claim 9, wherein the discharge output adapter is selected from the group consisting of: PVC fittings, PVC piping, and polyethylene tubing.

11. The water pumping kit assembly according to claim 7, wherein the solar powered water pump is a bilge pump.

12. A portable solar powered water pumping system having a plurality of plumping parts configured to be manually coupled and uncoupled to provide a water tight interference fit, the system comprising:

a solar powered water pump having an intake chamber and a water outflow nozzle, wherein the intake chamber having a diameter being substantially equal to the diameter of the pump housing;

at least one remotely located solar energy panel having a solar panel connector, the solar panel connector being coupled to the solar powered water pump;

a drain vent fitting having at least one intake end and one coupling end, wherein the coupling end is coupled to the water intake chamber;

at least one atrium grate coupled to the at least one intake end of the drain vent fitting;

a filter enclosed within the coupling of the at least one atrium grate at the at least one intake end; and a discharge output adapter coupled to the outflow nozzle, wherein said discharge adapter is configured to be connected to a plurality of fittings or connectors.

* * * * *